United States Patent [19]

Hohenfeldt

[11] 4,168,060

[45] Sep. 18, 1979

[54] PHYSICAL CONDITIONING APPARATUS

[76] Inventor: Danny R. Hohenfeldt, 3848 Concord Blvd., Concord, Calif. 94519

[21] Appl. No.: 796,728

[22] Filed: May 13, 1977

[51] Int. Cl.[2] ..... A63B 21/18; A63B 23/00

[52] U.S. Cl. ..... 272/94; 272/67; 272/117; 272/143; 273/DIG. 17

[58] Field of Search ..... 272/67, 94, 117, 118, 272/119, 120, 121, 143; 273/DIG. 17; 128/75

[56] References Cited

U.S. PATENT DOCUMENTS

| | | | |
|---|---|---|---|
| 761,504 | 5/1904 | Kleinbach | 272/120 |
| 1,234,793 | 7/1917 | Olds | 272/120 |
| 1,530,748 | 3/1925 | Alastalo | 272/119 |
| 1,556,496 | 10/1925 | Davis | 272/120 |
| 2,475,656 | 7/1949 | Bidak | 272/67 |
| 2,855,202 | 10/1958 | Kinne | 272/94 |
| 3,156,239 | 11/1964 | Uribe | 128/75 |
| 3,982,755 | 9/1976 | Sarich | 272/117 |

FOREIGN PATENT DOCUMENTS

| | | | |
|---|---|---|---|
| 487905 | 11/1952 | Canada | 272/94 |
| 1321733 | 2/1963 | France | 272/121 |

*Primary Examiner*—Richard T. Stouffer

[57] ABSTRACT

The disclosed physical conditioning apparatus makes use of standard bar bell disks. One part of the disclosed apparatus is a jump-rope. The disclosed apparatus includes a concave, rigid shell, a skull cap or webbing which is adjustable to tightly fit the user's head, a suspension for attaching the shell to the skull cap, and chin straps for securing the skull cap to the user's head. The shell is provided with a fastener for fastening bar bell disks onto its top surface. This fastener is provided with a large eye at its outer end. The shell can be stood on the floor with the flat top surface of the shell parallel to the floor. The eye of the shaft is large enough to pass the handles of the jump rope. The handles of the jump rope can be fastened together at their inner ends to form a drum on which the rope can be wound. An opening is provided in the drum part of each handle through which its associated ends of the jump rope passes when the handles are joined together. A locking device is provided to lock the midpoint of the jump rope to the eye of the shaft.

3 Claims, 3 Drawing Figures

PHYSICAL CONDITIONING APPARATUS

FIELD OF THE INVENTION

The present invention relates to physical conditioning apparatus, and more particularly to physical conditioning apparatus for exercising and developing the attenuate or small cross-section portions of the human body, such as the neck and wrists.

DESCRIPTION OF THE PREFERRED EMBODIMENT

Neck exercising devices comprising a helmet arrangement whereby weights can be affixed to the user's head for carrying out certain well-known neck muscle conditioning routines or procedures are known in the prior art. Also known in the prior art are wrist exercising devices for exercising and developing the wrist muscles of the user by permitting the user to wind a rope on a drum located between two axial handles, a weight being affixed to the lower end of the rope. In the known prior art, however, it was necessary for the physical training advocate or enthusiast to purchase and find storage for these two different, specialized devices, along with a considerable amount of general physical training apparatus, such as bar bells and a jump rope. Apart from the cost, which is not inconsiderable, many persons who might have benefitted from the use of such specialized physical conditioning devices have been deterred from thus benefitting themselves by the storage space necessary to accommodate such specialized devices, in addition to the space necessary for the storage of general conditioning apparatus, such as bar bells, lifter's benches, jump ropes, and the like. This is particularly true in the case of the many persons who live at considerable distances from gymnasiums and the like, and the persons who, for reasons of their own, such as the necessity to stringently limit the time devoted to physical conditioning due to business or professional responsibilities or the like, must store their physical conditioning apparatus between uses in their home, professional or business offices, or the like.

SUMMARY OF THE INVENTION

Accordingly, it is an object of the present invention to provide specialized physical conditioning apparatus for exercising and developing the neck and wrists which is at the same time lower in cost and more compact than the now conventional separate apparatus for use in performing the same exercises.

It is another object of the present invention to provide physical conditioning apparatus for the neck and wrists which utilizes standard bar bell disks for the weight portion of the apparatus, and thus reduces the cost of the apparatus and the amount of apparatus which the user must store in his workout area.

It is yet another object of the present invention to provide physical conditioning apparatus for the neck and wrists which incorporates another generally used exercise device, i.e., jump rope, and thus reduces the overall cost of physical conditioning apparatus to the individual physical trainee, and the necessary amount of storage space.

Other objects of the invention will in part be obvious and will in part appear hereinafter.

With these objects in view the present invention comprises as a principal feature the provision of novel physical conditioning apparatus for the neck and wrists, comprising a helmet adapted to be securely affixed to the head of the user and to carry one or more standard bar bell disks of selected weight.

In accordance with another feature of the present invention the fastening means for fastening a set of bar bell disks to said helmet further comprises a large eye for accommodating the handles of an associated jump rope.

In accordance with yet another feature of the present invention the handles of said associated jump rope each comprise a graspable portion, a flange and a drum-defining cylindrical portion, and said cylindrical portions each include an opening for the passage of the jump rope.

In accordance with an additional feature of the present invention, said handles can be fastened together in abutting end-to-end relation to define a flanged drum and axial handles on each end thereof.

Another feature of the present invention is the provision of a friction fastening device to frictionally lock the middle portion of said jump rope to said eye.

The present invention, accordingly, comprises the features of construction, combinations of elements, and arrangements of parts which will be exemplified in the construction hereinafter set forth, and the scope of the invention will be indicated in the appended claims.

For a fuller understanding of the nature and objects of the invention reference should be had to the following detailed description of the preferred embodiment, taken in conjunction with the accompanying drawings.

DESCRIPTION OF THE PREFERRED EMBODIMENT

Figure 1:
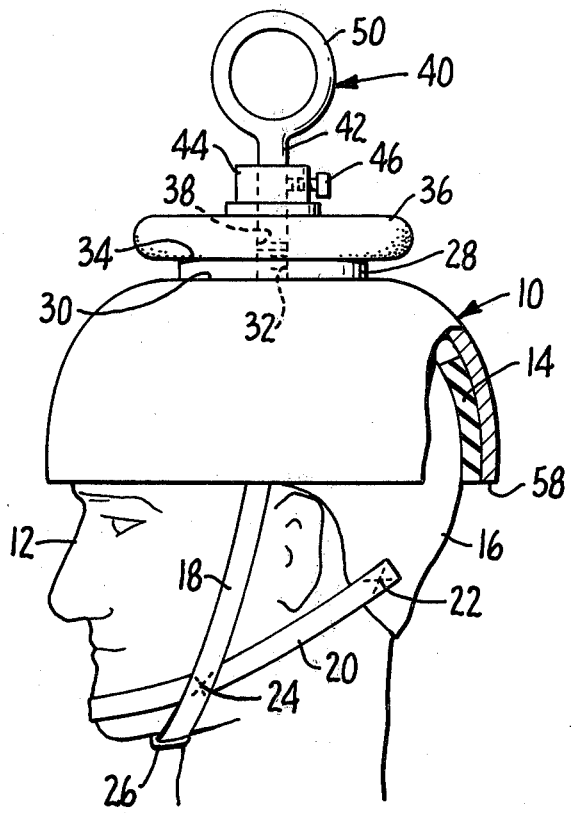
FIG. 1 shows the device of a preferred embodiment of the invention as used in carrying out a program of neck muscle exercising and development.

Referring to FIG. 1, there is shown the device of the preferred embodiment of the present invention as used in carrying out a program of neck muscle exercising and development.

The apparatus of the preferred embodiment as shown in FIG. 1 comprises a concave, rigid shell 10 which is of sufficient size as to fit over the head of the user 12, leaving sufficient space to accommodate suspension means, including suspension element 14, and a skull cap 16 or webbing cap which closely fits the head of the user 12.

As further seen in FIG. 1, skull cap 16 is firmly affixed to the head of user 12 by means of chin straps 18, 20. Chin strap 20 is affixed to skullcap 16 by stitching 22, and by similar stitching (not shown) located at the other side of the user's head. Similarly, the upper end of chin strap 24 as seen in FIG. 1 is affixed to skullcap 16 by stitching (not shown), and the opposite end of chin strap 18 is affixed to skullcap 16 by stitching located on the other side of the user's head. After skullcap 16 is firmly positioned on the head of user 12, and chin strap 20 is positioned as shown in FIG. 1, the two parts of chin strap 18 are fastened to each other under the user's chin by means of a suitable buckle 16. Adjusting means for adjusting the length of chin strap 20 and adjusting the lengths of the two parts of chin strap 18 may be provided by those having ordinary skill in the art without the exercise of invention.

In accordance with the principles of the present invention, rigid, concave, shell 10 is affixed to skullcap 16 by means of four or more semi-rigid suspension means, of which only suspension means 14 is shown herein. Each of said suspension means is secured both to skullcap 16 and to shell 10 by means the provision of which is within the scope of those having ordinary skill in the art without the exercise of invention.

As also seen in FIG. 1, a flat platform 28 is integral with the top surface 30 of shell 10. Shell 10 is provided with a threaded bore 32, which extends perpendicular to the upper, flat face of platform member 28.

In the particular use of the device of the preferred embodiment shown in FIG. 1, a standard bar bell disk 36 is disposed on upper face 34 of platform 28. The central bore 38 of bar bell disk 36 is aligned with the threaded bore 32 in platform member 28. Bore 38 in bar bell disk 36 is slightly larger in diameter than threaded bore 32 in platform 28, and is not internally threaded. A fastener 40, or rather the shaft 42 thereof, passes through bore 38 in bar bell disk 36, and is provided with external threads which are interengaged with the internal threads in bore 32.

Before fastener 40, or shaft 42 thereof, is passed through bore 38 of bar bell disk 36, and screwed into the threads in bore 32, a standard bar bell collar 44 is slipped over shaft 42 of fastener 40. Thus, standard bar bell disk 36 can be securely fastened to shell 10, and brought in close contact with face 34 of platform member 28 by passing shaft 42 through bar bell collar 44, screwing shaft 42 into bore 32, and then bringing bar bell collar 44 into tight contact with the top of bar bell disk 36, and finally securing bar bell collar 44 to shaft 42 by means of set screw 46, in the well-known manner.

Shaft 42, exclusive of the eye 50 shown in FIG. 1, is of sufficient length so that two bar bell disks can be secured to shell 10 by means of fastener 40, eliminating bar bell collar 44 when the two bar bell disks are of sufficient thickness so that eye 50 contacts the top of the upper bar bell disk when the lower end of shaft 42 is screwed into the internal threads in bore 32. Thus, it will be seen that by the simple, rugged, and easy-to-fabricate parts shown in FIG. 1, a wide variety of weights can be affixed to shell 10, disposed upon face 34 of platform 28. It will now be obvious to those having ordinary skill in the art, informed by the present disclosure, how the apparatus of the preferred embodiment shown in FIG. 1 may be used in exercising and developing the neck of user 12, by following out certain well-known standard neck exercise routines day-by-day, and progressively increasing the weight affixed to shell 10.

Figure 2:
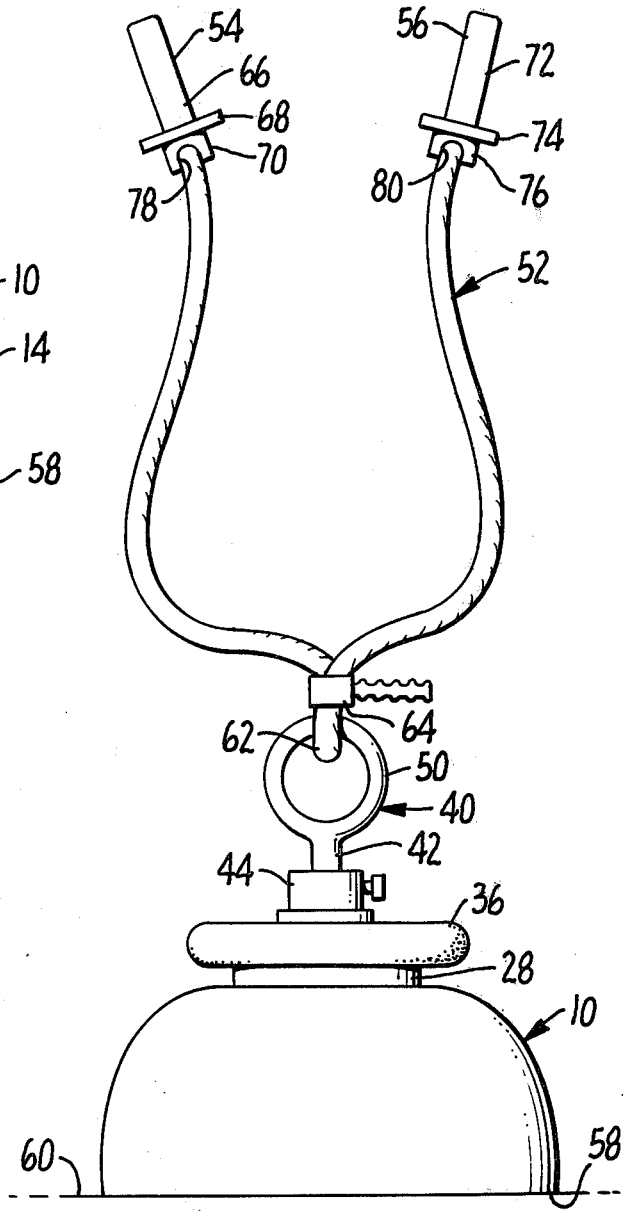
FIG. 2 shows the device of said preferred embodiment of the invention as used in carrying out a program of wrist muscle exercising and development, before the handles are joined to provide a rope drum.
Figure 3:
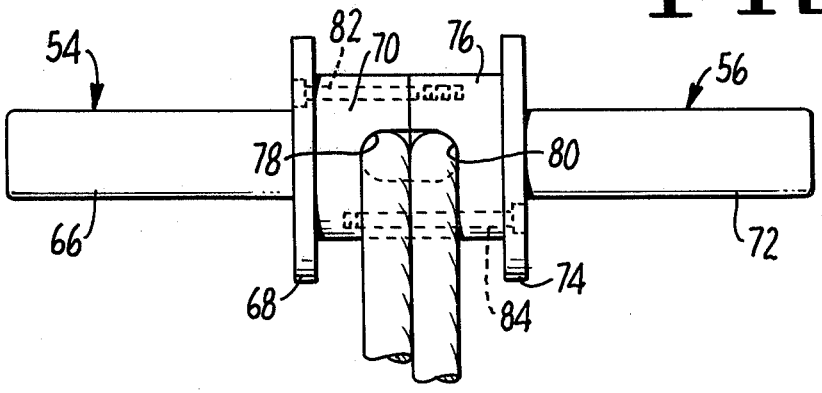
FIG. 3 shows the jump rope handles of the apparatus of said preferred embodiment joined to provide a rope drum.

Referring now to FIGS. 2 and 3, there is shown the device of said first preferred embodiment of the present invention as used in carrying out a program of wrist muscle exercising and development.

As seen in FIG. 2, the apparatus of the preferred embodiment, when used for exercising and developing the wrists, includes a jump rope 52, which is provided with handles 54, 56, which are especially adapted to carry out the present invention.

As may further be seen from FIG. 2, the eye 50 of fastener 40 is sufficiently large to pass either handle 54 or handle 56 of jump rope 52.

As also seen in FIG. 2, the lip 58 of shell 10 lies in a single plane parallel to the face 34 of platform 28 (FIG. 1). Thus, when skullcap 16 and chinstraps 18,20 are tucked inside shell 10, shell 10 can be firmly stood upon the floor 60. (FIG. 2), and the axis of shaft 42 will be perpendicular to floor 60.

When it is desired to assemble the device of the preferred embodiment for exercising the wrists, shell 10 is thus disposed upon floor 60, (FIG. 2), one handle of jump rope 52 is passed through eye 50 until a central portion 62 of jump rope 52 passes through eye 50, and said central portion 62 of jump rope 52 is secured to eye 50 by means of a bundler 64, of the type well-known for bundling electrical wires into demountable cables, closing large plastic sacks, etc.

Referring now to FIG. 3, there is shown the manner in which the two handles 54, 56 are joined together to form a smooth drum on which jump rope 52 can be wound while slowly raising shell 10 and weight 36 from floor 60, for exercising and conditioning the wrists in the well-known manner.

As best seen by comparing FIGS. 2 and 3, jump rope handle 54 comprises a graspable portion 66, a flange 68, and a hollow cylindrical terminal portion 70, and jump rope handle 56 comprises a graspable portion 72, a flange 74, and hollow, cylindrical terminal portion 76.

The hollow, cylindrical terminal portion 70 of jump rope handle 54 is provided with a slot 78 adapted to pass jump rope 52, and the hollow, cylindrical terminal portion 76 of jump rope handle 56 is provided with a slot 80 adapted to pass another portion of jump rope 52.

As seen in FIG. 3, bolts 82 and 84 are provided, whereby jump rope handles 54 and 56 may be firmly secured together, the hollow, cylindrical terminal portion 70, 76 defining a drum terminating at its outer ends in the flanges 68, 74. When jump rope handles 54 and 56 are thus secured together, jump rope 52 projects through slots 78, 80, whereby jump rope 52 can be smoothly wound on said drum when said drum is rotated about its central axis by the user, by means of said graspable portions 66, 72.

As will be evident to those having ordinary skill in the art, informed by the present disclosure, the user of a device of the present invention who thus, while standing on floor 60 (FIG. 2) near shell 10, winds jump rope 52 on said drum, and thus raises shell 10, bar bell disk 36, etc., from floor 60, will subject his wrists to considerable exercise and conditioning, especially when the user carries out a systematic program of so doing, successively increasing the weight of the bar bell disk or disks affixed to shell 10 by means of fastener 40.

As will also be evident to those having ordinary skill in the art, jump rope 52, when detached from eye 50, and when its handles 54, 56 are detached from each other by the removal of bolts 82 and 84 can be used as a jump rope to exercise his legs and lower extremities generally, in the well-known manner.

It will thus be seen that the objects set forth above, among those made apparent from the preceding description, are efficiently attained, and, since certain changes may be made in the above constructions without departing from the scope of the present invention, it is intended that all matter contained in the above description or shown in the accompanying drawings shall be interpreted as illustrative only, and not in a limiting sense.

It is also to be understood that the following claims are intended to cover all of the generic and specific features of the present invention herein described, and all statements of the scope of the present invention which might, as a matter of language, be said to fall therebetween.

What is claimed is:

1. Physical conditioning apparatus, comprising:

a substantially rigid concave member at least a substantial part of the lip of which lies in a plane;

securing means for securing said concave member to the head of a conditionee with said plane intersecting the head of the conditionee above the conditionee's eyes and ears;

fastening means for fastening at least one bar bell disk to the part of said concave member remote from said lip and maintaining said at least one bar bell disk parallel to said plane;

a jump rope having first and second handles affixed to its opposite ends, the opening in said eye being of sufficient diameter so that one of said handles of said jump rope can be passed completely therethrough; and means for binding together a first portion of said jump rope and a second portion of said jump rope and thereby locking a loop of said jump rope to said eye;

said fastening means comprising a shaft removably fastenable in a cylindrical opening in the top of said concave member, the axis of said shaft being perpendicular to said plane when said shaft is fastened in said cylindrical opening;

the end of said shaft remote from said concave member terminating in an eye, the axis of said eye being substantially perpendicular to the axis of said shaft;

each of said jump rope handles comprising a graspable portion, a flange, and a hollow cylindrical terminal portion.

2. Physical conditioning apparatus as claimed in claim 1, further comprising:

attaching means for attaching said handles together with said terminal portions in end-to-end, abutting relation; and registering openings in the end portions of the cylindrical walls of said terminal portions remote from said flanges, said jump rope passing through said registering openings when said handles are attached together in end-to-end relation and said terminal portions and said flanges together defining a drum upon which said jump rope can be wound by grasping said graspable portions and rotating said handles about their common axis.

3. Physical conditioning apparatus as claimed in claim 2 in which said binding means is a resilient bundler for repeatedly binding said first and second portions of said jump rope and then releasing said first and second portions of said jump rope.

* * * * *